US011725429B2

(12) United States Patent
Fontanet et al.

(10) Patent No.: US 11,725,429 B2
(45) Date of Patent: Aug. 15, 2023

(54) EMERGENCY ACCESS DEVICE FOR A VEHICLE DOOR HAVING A POSITION DETECTION COIL

(71) Applicant: Vitesco Technologies GmbH, Regensburg (DE)

(72) Inventors: Alain Fontanet, Toulouse (FR); Steffen Eckhardt, Toulouse (FR)

(73) Assignee: Vitesco Technologies GmbH

( * ) Notice: Subject to any disclaimer, the term of this patent is extended or adjusted under 35 U.S.C. 154(b) by 0 days.

(21) Appl. No.: 17/775,429

(22) PCT Filed: Dec. 10, 2020

(86) PCT No.: PCT/EP2020/085634
§ 371 (c)(1),
(2) Date: May 9, 2022

(87) PCT Pub. No.: WO2021/116346
PCT Pub. Date: Jun. 17, 2021

(65) Prior Publication Data

US 2022/0396982 A1 Dec. 15, 2022

(30) Foreign Application Priority Data

Dec. 12, 2019 (FR) ..... 1914233

(51) Int. Cl.
*E05B 81/90* (2014.01)
*E05B 79/20* (2014.01)
(Continued)

(52) U.S. Cl.
CPC ..... *E05B 81/90* (2013.01); *E05B 77/02* (2013.01); *E05B 79/20* (2013.01); *E05B 81/64* (2013.01)

(58) Field of Classification Search
CPC ..... E05B 81/90; Y10T 292/1022; Y10T 292/1028; Y10T 292/11
See application file for complete search history.

(56) References Cited

U.S. PATENT DOCUMENTS 2,126,234 A * 8/1938 Weber ..... F16C 1/16 74/502
2,172,294 A * 9/1939 Riddell ..... G03B 9/58 74/502
(Continued)

FOREIGN PATENT DOCUMENTS

CN 102264582 A 11/2011
DE 102006037766 A1 * 2/2008 ..... E05B 77/00
(Continued)

OTHER PUBLICATIONS

English translation of Written Opinion for International Application No. PCT/EP2020/085634, dated Mar. 12, 2021, 6 pages.
(Continued)

*Primary Examiner* — Carlos Lugo
(74) *Attorney, Agent, or Firm* — RatnerPrestia

(57) ABSTRACT

An emergency access device for an opening element of a vehicle, including: a body; a pull tab; a retention needle; a mechanical ejector; and an electric ejector which includes: a magnetic circuit surrounding the ferromagnetic core of the retention needle; an activation coil connected to an electric magnetization circuit, the activation coil being designed to magnetize the magnetic circuit and attract the ferromagnetic core of the retention needle; and a detection coil for detecting the position of the retention needle, the detection coil being connected to a detection circuit designed to measure the inductance of the detection coil.

12 Claims, 7 Drawing Sheets

(51) Int. Cl.
*E05B 77/02* (2014.01)
*E05B 81/64* (2014.01)

(56) References Cited

U.S. PATENT DOCUMENTS 2,468,969 A * 5/1949 Galey ..... E05C 17/56 292/144
2,499,727 A * 3/1950 Craig ..... E05B 77/48 292/DIG. 3
2,765,648 A * 10/1956 Hatcher ..... E05B 47/0603 292/144
2,828,151 A * 3/1958 Brotman ..... E05B 81/90 180/289
3,004,772 A * 10/1961 Bohlen ..... B60P 1/6481 280/433
3,731,963 A * 5/1973 Pond ..... E05B 83/24 292/144
3,751,086 A * 8/1973 Geringer ..... E05B 47/0002 292/144
4,132,439 A * 1/1979 Millar ..... E05B 63/248 70/279.1
4,236,757 A * 12/1980 Gregory ..... B60P 1/162 298/22 C
4,367,454 A * 1/1983 Modica ..... B60R 25/1001 340/426.34
5,216,909 A * 6/1993 Armoogam ..... E05B 47/0603 292/144
5,360,243 A * 11/1994 Hirsh ..... E05B 47/026 292/144
5,588,318 A * 12/1996 Osborne ..... E05C 1/004 292/144
6,035,675 A * 3/2000 Zimmer ..... E05B 47/026 70/276
6,276,563 B1 * 8/2001 Saldana ..... H05K 13/028 222/197
9,885,515 B2 * 2/2018 Osbar ..... F25D 23/028
2011/0260831 A1 10/2011 Ieda et al.
2019/0169889 A1 6/2019 Beck

FOREIGN PATENT DOCUMENTS

DE 102014204606 A1 * 9/2015 ..... D06F 37/28
FR 3081485 A1 11/2019
WO WO-2005041153 A2 * 5/2005 ..... E05B 67/003
WO 2018024405 A1 2/2018

OTHER PUBLICATIONS

International Search Report and Written Opinion for International Application No. PCT/EP2020/085634, dated Mar. 12, 2021, 8 pages.
International Search Report and Written Opinion for International Application No. PCT/EP2020/085634, dated Mar. 12, 2021, 11 pages (French).
Chinese Office Action for Chinese Application No. 202080085759.8, dated Jan. 13, 2023 with translation, 17 pages.

* cited by examiner

EMERGENCY ACCESS DEVICE FOR A VEHICLE DOOR HAVING A POSITION DETECTION COIL

CROSS REFERENCE TO RELATED APPLICATIONS

This application is the U.S. National Phase Application of PCT International Application No. PCT/EP2020/085634, filed Dec. 10, 2020, which claims priority to French Patent Application No. 1914233, filed Dec. 12, 2019, the contents of such applications being incorporated by reference herein.

FIELD OF THE INVENTION

The invention relates to the automotive field and concerns an emergency access device associated with an opening element of a vehicle.

BACKGROUND OF THE INVENTION

To allow access to a motor vehicle, the opening elements of this vehicle (the doors, for example) are provided with access devices. The most common access devices are handles mechanically connected to a lock so that actuation of the handle by the user actuates the lock and allows opening.

Furthermore, more advanced access devices currently exist in which no mechanical connection is required for normal operation of the access device. These devices generally comprise a sensor for sensing the presence of the user's hand. If the user is authorized to open the vehicle, for example if he or she is carrying a required fob, the vehicle then actuates an electric opener in the lock of the opening element and thus allows access to the vehicle.

These access devices allow a reduction in weight, size and cost and also greater ease of use since no physical connection with the lock is necessary in normal operation. However, for safety reasons in particular, these access devices nevertheless require an emergency access device providing a mechanical connection with the lock of the opening element in the event of an emergency or of an electrical breakdown.

Vehicles provided with access devices having no mechanical connection, in normal operation, between the handle of an opening element and its lock are known. These known devices comprise an emergency access device comprising a means for actuating the lock, this emergency actuation means being mechanical and withdrawable.

SUMMARY OF THE INVENTION

An aspect of the invention is an improvement over the emergency access devices of the prior art so as to make it safe to open, in the event of an emergency, an opening element provided with an access device having no mechanical connection between the handle and the lock of the opening element.

To that end, an aspect of the invention concerns an emergency access device for an opening element of a vehicle, comprising:

- a body;
- a grippable pull tab which is connected to a lock actuator and can move between: a retracted position in which the pull tab is withdrawn in the body; and a deployed position in which the pull tab protrudes out of the body;

- a retention needle which can move transversely to the pull tab and is designed to occupy a blocking position where it is arranged against the pull tab, keeping the pull tab in its retracted position, the retention needle comprising a ferromagnetic core;
- a mechanical ejector designed to release the pull tab from its retracted position; and
- an electric ejector designed to release the pull tab from its retracted position, the electric ejector comprising an electromagnet designed to move the retention needle from its blocking position to its release position, this electromagnet comprising:
  - a magnetic circuit surrounding the ferromagnetic core of the retention needle;
  - an activation coil connected to an electric magnetization circuit, the activation coil being designed to magnetize the magnetic circuit and attract the ferromagnetic core of the retention needle; and
  - a detection coil for detecting the position of the retention needle, the detection coil being connected to a detection circuit designed to measure the inductance of the detection coil.

Another aspect of the invention concerns a vehicle equipped with such a device.

Another aspect of the invention concerns a method for controlling an emergency access device for an opening element of a vehicle, comprising the following steps:

- the detection circuit supplying electric power to the detection coil;
- the detection circuit measuring the inductance of the detection coil; and
- activating a warning means if the measured inductance relates to a position of the retention needle which is outside its blocking position.

The emergency access device according to an aspect of the invention performs two distinct functions, for example within a vehicle:

- in the event of the vehicle being in an accident, an opening element such as a door of the vehicle must be able to be opened from the outside by the emergency services. The doors have generally been unlocked during the accident. The vehicle also controls the electric ejector of the emergency access device so that the pull tab is released and occupies its deployed position. The opening element is thus ready to be opened manually from the outside by virtue of the mechanical connection provided by the pull tab ready to be grasped;
- in the event that the vehicle no longer has the necessary electrical energy (discharged battery, for example), the user can manually actuate the emergency access device so that the mechanical ejector releases the pull tab so that it occupies its deployed position and can be actuated by the user.

An aspect of the invention allows it to be made safe to implement the emergency access device by guaranteeing that the pull tab is indeed present in its normal rest position, that is to say withdrawn in the body.

Specifically, the emergency access device is intended to be used only in the event of an accident or of an electrical failure. These situations being by definition rare, the emergency access device can remain for long periods, for example several years, without being used. However, the emergency access device must be operational non-stop, that is to say that it must be fully functional as soon as it is requested, which can happen at any time.

The detection coil for detecting the position of the retention needle makes it possible, using means which are simple, reliable and integrated into the general operation of the device, to check the actual presence of the position of the retention needle. Given the architecture of the emergency access device, and the arrangement of the pull tab relative to the retention needle, checking the position of the retention needle directly reflects the presence or the absence of the pull tab in its place in the body of the device.

The emergency access device necessarily comprises a manual ejector for performing the emergency opening function in the event of an electrical failure. An action on the mechanical ejector ejects the pull tab out of the body. If this action on the mechanical ejector is an untimely action which takes place without the user being present, the user can be unaware that the pull tab has been ejected. For example, a malicious action on the vehicle can consist in ejecting the pull tab from its housing by virtue of the mechanical ejector, then in making it unusable (cut cable, for example). A particularly critical situation can then occur in this type of situation, putting the emergency opening device out of use.

As the emergency access device is rarely used and in general not very visible, there is a risk that the absence of the pull tab is not noticed by the user of the vehicle. The emergency access device can thus remain out of use for long periods, and the absence of the pull tab will be noticed only when the user desires to use the emergency access device, which will therefore be inoperative, which from the safety point of view is therefore a critical situation.

An aspect of the invention makes it possible to ensure that the pull tab is actually present in the body and therefore that the emergency access device is in an operational state. This check could be carried out, for example, each time the vehicle is started. It will thus be possible to warn the user of the vehicle that an incident which led to the untimely ejection of the pull tab has occurred.

In addition, the user of the vehicle can be warned using communication means, for example on his or her mobile terminal, if the vehicle is equipped with adequate communication means.

The device according to an aspect of the invention can comprise the following additional features, alone or in combination:

- the detection circuit comprises an indicator of the position of the retention needle depending on the measurement of the inductance of the detection coil;
- the detection circuit comprises a warning means for warning if the indicator indicates a position of the retention needle outside its blocking position;
- the retention needle is mounted so as to be able to slide in the body and comprises an end-of-travel stop for ending sliding relative to the body, and the retention needle is designed to occupy, in addition to the blocking position, an end-of-travel position in which the end-of-travel stop is against the body;
- the magnetic circuit comprises an actuation finger arranged opposite the ferromagnetic core of the retention needle;
- the airgap between the ferromagnetic core and the actuation finger, when the retention needle is in its blocking position, is at least equal to the distance separating the blocking position of the retention needle from another of its positions;
- the activation coil and the detection coil are produced by one and the same solenoid arranged in the magnetic circuit, this solenoid being alternately connected to the electric magnetization circuit and to the detection circuit; and
- the detection coil is supplied with power by the detection circuit at a frequency close to 10 KHz.

BRIEF DESCRIPTION OF THE DRAWINGS

Other features and advantages of aspects of the invention will become apparent from the following non-limiting description, with reference to the appended drawings, in which.

DETAILED DESCRIPTION OF THE PREFERRED EMBODIMENTS

Figure 1:
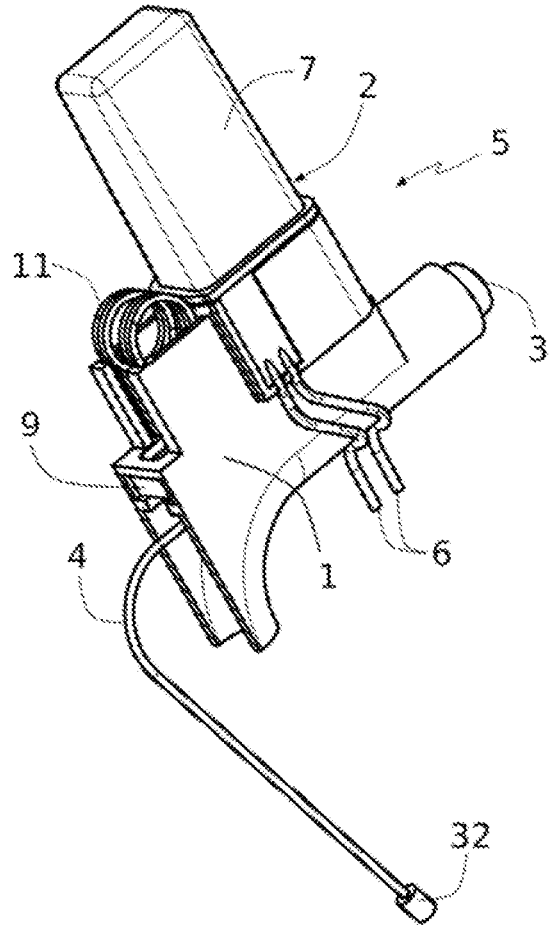
FIG. 1 shows, in perspective, an emergency access device according to an aspect of the invention.

FIG. 1 shows an emergency access device 5 for an opening element of a vehicle, in perspective. This device 5 comprises a body 1 on which an electric actuator 2 is mounted. A button 3 is accessible on the body 1 and an opening cable 4 protrudes from the body 1. Two cables 6 connect the electric actuator 2 on the one hand to an electric magnetization circuit and on the other hand to a detection circuit (these circuits will be described below).

The emergency access device 5 is, for example, intended to be housed in an emergency access box (which is not shown) of an opening element of a motor vehicle. This opening element is, for example, a door of the vehicle. This door of the vehicle is furthermore provided with an access device which opens the lock electrically on the basis of information from a sensor for sensing the presence of an identified user's hand. The emergency access device 5 housed in the emergency access box is not used in normal operation. This emergency access box is preferably arranged close to the opening handle.

The body 1 of the emergency access device 5 is preferably concealed in the emergency access box so that only the button 3 protrudes and is accessible by the user.

The emergency access device 5 makes it possible to actuate, through pulling, a lock actuator which is, in the present example, an opening cable 4 in the following two cases:

- in the event of a particular event, such as an accident, an electric ejector automatically releases a pull tab 10 so as to allow a person to open the door from the outside during an emergency operation; and
- in the event of a failure of the electrical system, a manual ejector for ejecting the pull tab 10 allows a user of the vehicle to open the vehicle by actuating the button 3.

Figure 2:
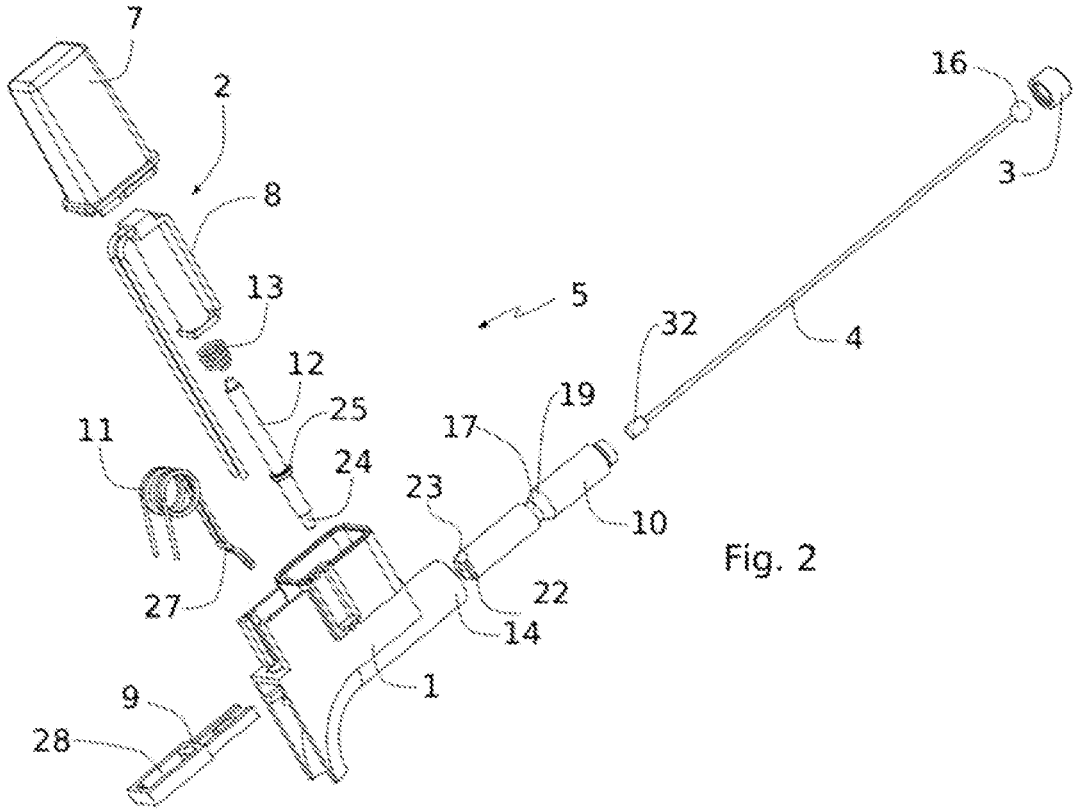
FIG. 2 is an exploded view of the device of FIG. 1.

The exploded view of FIG. 2 shows all the parts forming the emergency access device 5.

The electric ejector consists of the electric actuator 2, which here comprises an electromagnet 8 housed in a protective cover 7.

The mechanical ejector consists of a slide 9 which is mounted inside the body 1.

The pull tab 10 is also housed inside the body 1 and is intended to be handled after it has been ejected from the body 1 following the action of the electric ejector or of the mechanical ejector. The pull tab 10 comprises the button 3 at one of its ends. The cable 4 is threaded in the pull tab 10.

A first spring 11 is designed to act on the pull tab 10 with a view to it being ejected by either the electric ejector or the mechanical ejector.

The device 5 comprises a retention needle 12 which makes it possible to block the pull tab 10, this needle 12 being acted on by a second spring 13.

Figure 3:
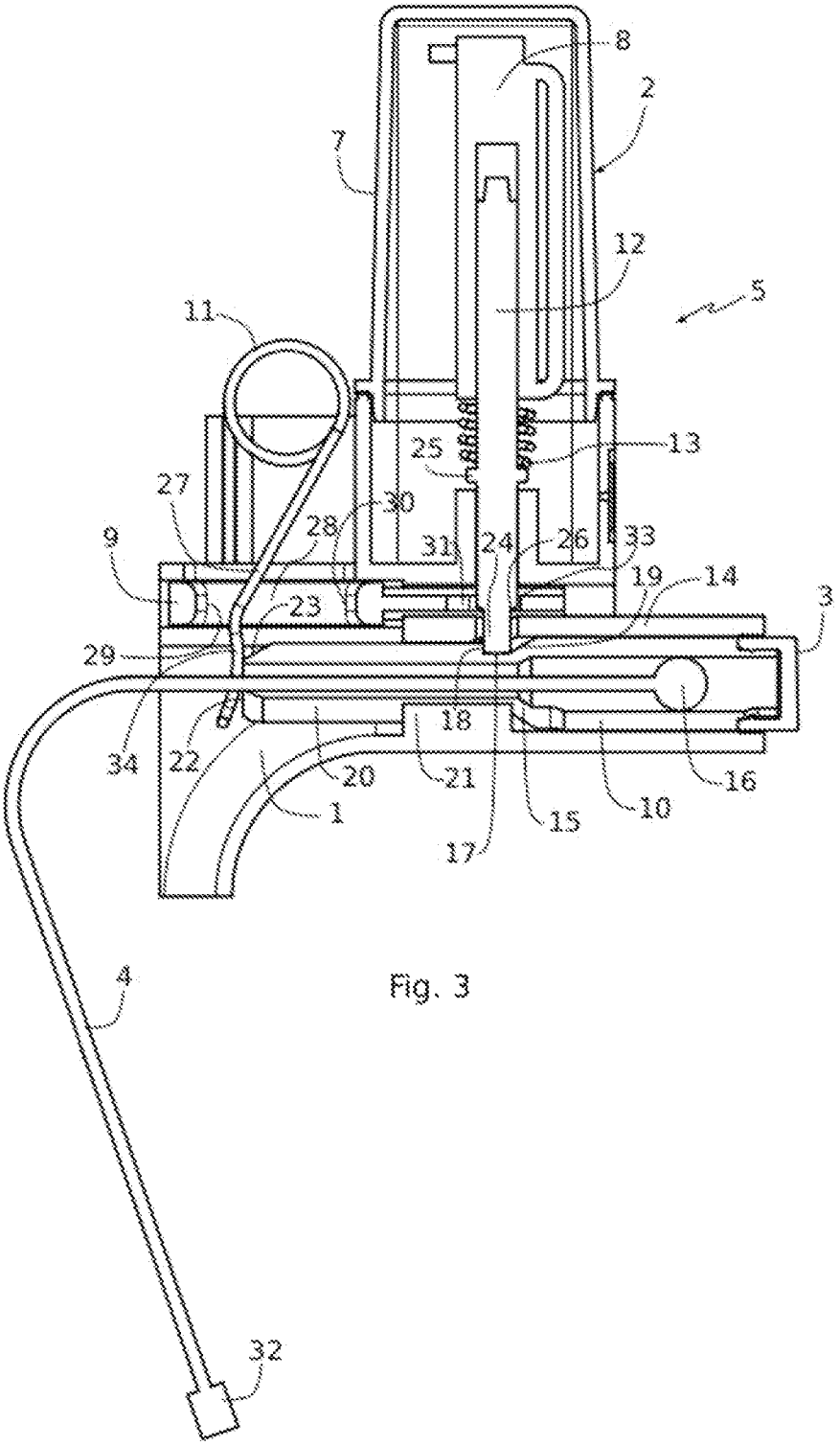
FIG. 3 is a longitudinal sectional view of the device of FIG. 1.

FIG. 3 is a longitudinal sectional view depicting the arrangement of the parts which have just been described inside the body 1. In the position shown in FIG. 3, which corresponds to the position of FIG. 1, the device 5 is in the rest state and emergency access is not requested.

Figure 5:
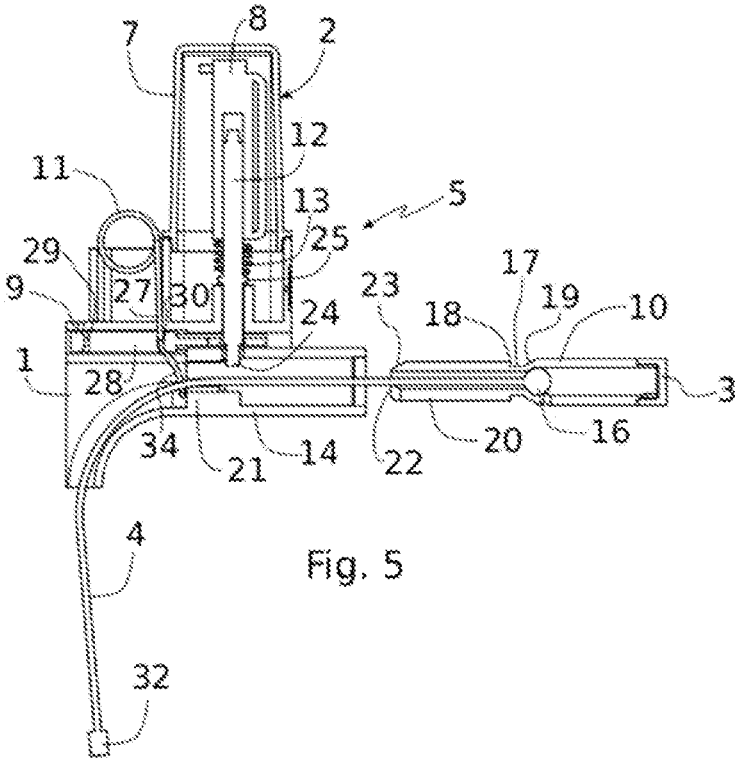
FIG. 5 illustrates the device of FIG. 1 in a first position during electrical ejection.
Figure 6:
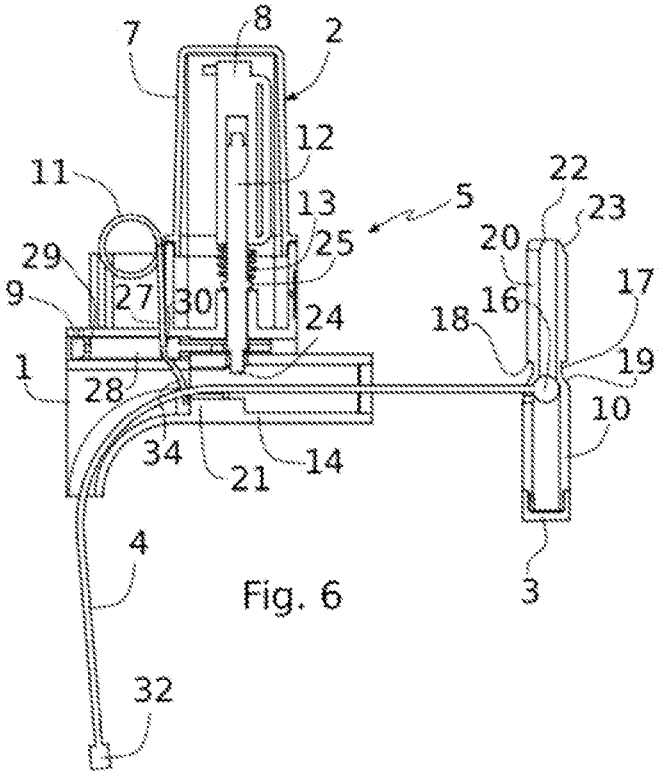
FIG. 6 illustrates the device of FIG. 1 in a second position during electrical ejection.

The pull tab 10 is mounted so as to be able to slide in a sheath 14 of the body 1 between a retracted position (that of FIG. 3) and a deployed position (that shown, for example, in FIGS. 5 and 6). The pull tab 10 has a hollow body provided with a shoulder 15 which makes it possible to block a first tip 16 of the cable 4. The hollow body of the pull tab 10 is closed at its end by the button 3. The second tip 32 of the cable 4 is intended to be connected to the lock (which is not shown) of the vehicle so that pulling on the cable 4 causes the door of the vehicle to open.

On its outer surface, the pull tab 10 comprises a radial slot 17 formed by a recess extending in a radial direction of the pull tab. The slot 17 is bordered on one side by an annular stop surface 18, and on the other side by a conical surface 19.

The pull tab 10 further comprises a longitudinal groove 20 associated with a tongue 21 which is secured to the body 1 and makes it possible to maintain the angular orientation of the pull tab 10 in the sheath 14 while it slides in the sheath. At the opposite end from the button 3, the pull tab 10 comprises a pressure end 22 provided with a bevel 23. As a variant, the pull tab 10 can have a square or rectangular section, thus meaning it does not need the tongue 21 or the groove 20.

The needle 12 is mounted so as to be able to move translationally over the body 1 along an axis perpendicular to the axis along which the sheath 14 extends. At one of its ends, the needle 12 comprises a stop finger 24 designed to be housed in the slot 17 of the pull tab 10.

The needle 12 is also mounted so as to be able to slide in the electromagnet 8 so that electrical activation of the electromagnet 8 causes the needle 12 to be lifted until the end of the needle 12 comes into abutment against the electromagnet 8. The needle 12 can thus move between a position referred to as the position in which the pull tab is released, in which the electromagnet 8 attracts the needle 12, and an opposite end position referred to as the end-of-travel position, in which the needle 12 is in abutment on the body 1 by means of its flange 25. In the position illustrated in FIG. 3, the needle 12 is positioned between these two extreme positions, the stop finger 24 coming into abutment against the bottom of the slot 17 of the pull tab 10. This position is referred to as the position in which the pull tab 10 is blocked. This is because the pull tab 10 is blocked in its retracted position by the stop finger 24, which bears on the stop surface 18.

The second spring 13 is arranged between the electromagnet 8 and the flange 25 so as to force the needle 12 from its release position to its end-of-travel position, while the presence of the pull tab 10 makes the intermediate third position possible, which is the blocking position of the needle 12.

The needle 12 further comprises a stop shoulder 26 close to the stop finger 24.

The first spring 11 is mounted in the body 1 so that one of its legs forms an ejection leg 27 which bears on the pressure end 22 of the pull tab 10 and which elastically forces the pull tab 10 to its deployed position. In the rest position of FIG. 3, the action of the ejection leg 27 on the pull tab 10 causes the stop surface 18 to press against the stop finger 24 and the pull tab 10 is thus locked in its withdrawn position.

The slide 9 is a part which can move translationally in the body 1 in a direction parallel to the axis of the sheath 14. The slide 9 comprises a first portion provided with a first groove 28. The ejection leg passes through the groove 28 and can move freely in this groove 28 in a direction parallel to the axis of the sheath 14. This groove 28 is bordered by a lateral blocking surface 29 and by a lateral release surface 30 which are designed to interact with the ejection leg 27.

The slide 9 also comprises a second portion provided with a second groove 31 surrounding the needle 12 and comprising a blocking rim 33.

Figure 4:
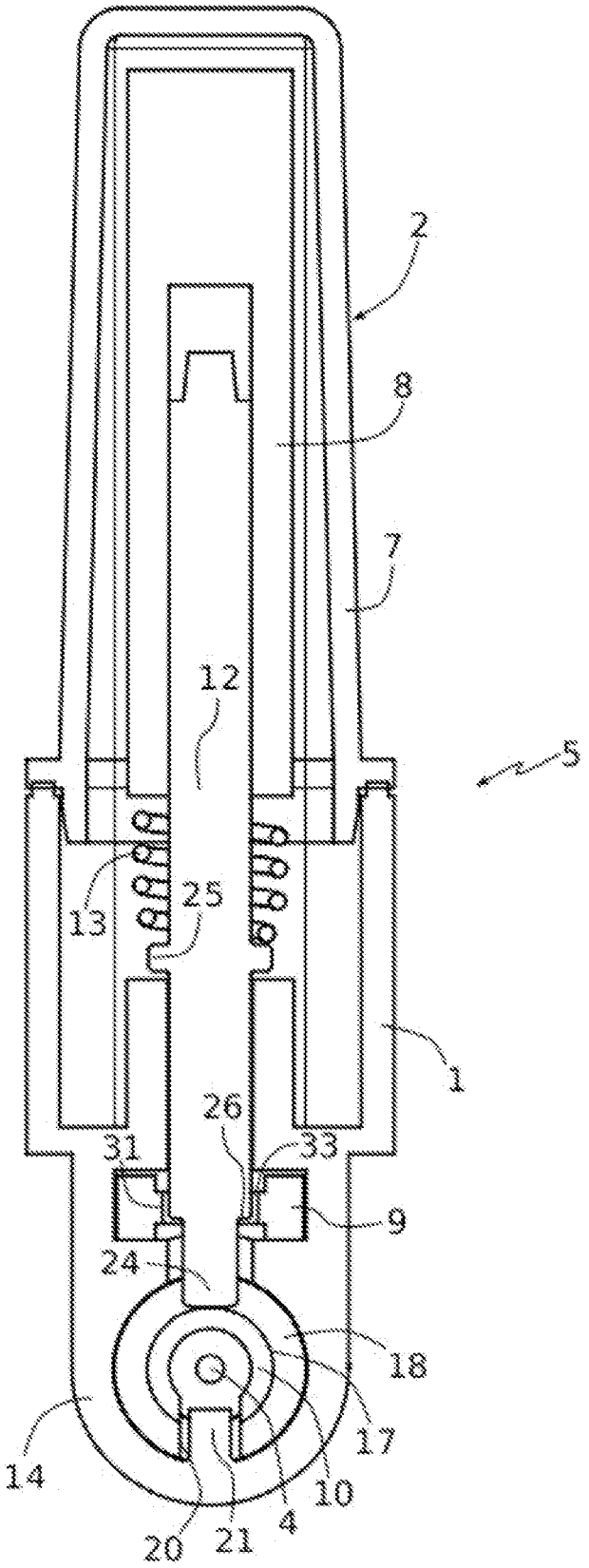
FIG. 4 is a cross-sectional view of the device of FIG. 1.

FIG. 4 is a cross-sectional view of the device 5 and details, in particular, the arrangement of the longitudinal groove 20 of the pull tab 10 and its interaction with the tongue 21 of the body 1, and also the interaction of the stop finger 24 of the needle 12 against the bottom of the slot 17.

The first function of the device 5, that of implementing the electric ejector, will now be described with reference to FIGS. 5 and 6.

From the rest position of FIG. 3, a control pulse is transmitted to the electromagnet. The electromagnet 8 is therefore first of all activated and the needle 12 is magnetically attracted in the direction of the electromagnet 8 in a lifting movement causing the stop finger 24 to retract from the slot 17. Since the pull tab 10 is no longer retained by the stop surface 18 pressing against the stop finger 24, the ejection leg 27 of the spring 11 then forces the pull tab 10 to be ejected and the pull tab is ejected from the sheath 14. As soon as the electromagnet 8 ceases to be activated, the second spring 13 brings the needle 12 back to an end-of-travel position in which the flange 25 comes into abutment against the body 1, the pull tab 10 already being in its deployment position. This position, resulting from an activation pulse of the electromagnet 8, is that shown in FIG. 5.

In accordance with FIG. 6, in its deployment position, the pull tab 10 then tilts around the first tip 16 of the cable 4 so that the cable 4 runs through the longitudinal groove 20 of the pull tab 10, making it possible to position the pull tab 10 horizontally so as to make it easier to grip with two fingers and allow the user to pull on the cable 4.

The pull tab 10 is thus advantageously sized so that its end bearing the button 3 is heavier than its opposite end in order to cause this tilting to go as far as the position of FIG. 6.

The second function of the emergency access device 5, which relates to implementing the mechanical ejector, will now be described with reference to FIGS. 7 and 8.

Figure 7:
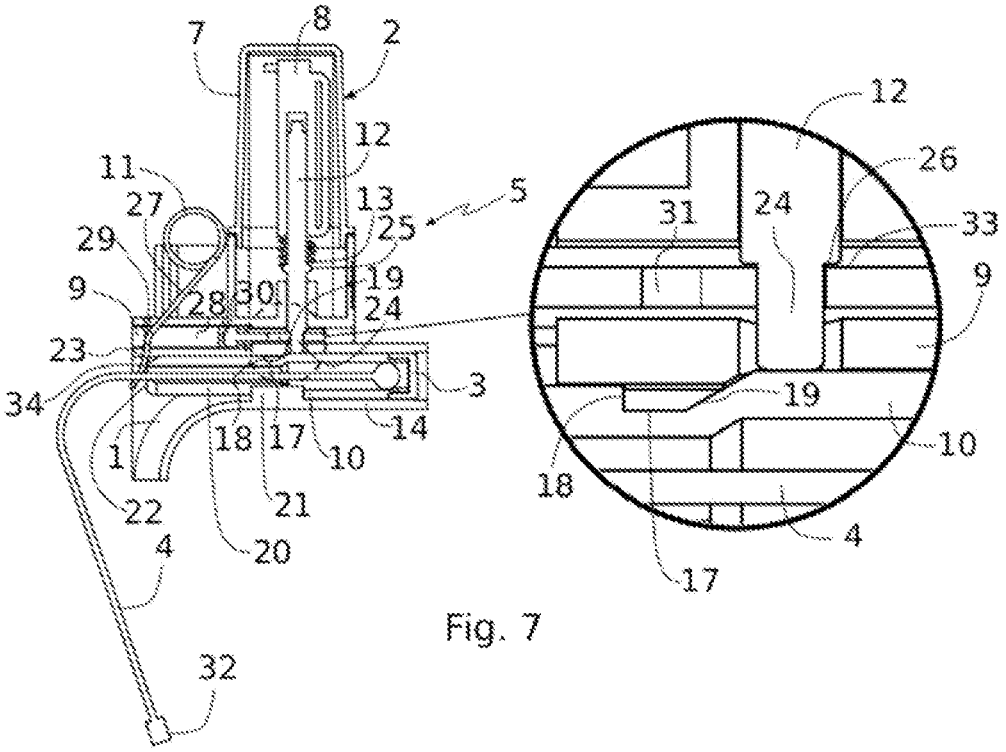
FIG. 7 illustrates the device of FIG. 1 in a first position during mechanical ejection.

When the user desires to manually open the door of the vehicle without resorting to the electrical means, he or she pushes the button 3 as far as possible into the sheath 14 as illustrated in FIG. 7. During this pressing movement, the translation of the pull tab 10 inside the sheath 14 causes the stop finger 24 to climb along the oblique path formed by the conical surface 19 of the pull tab 10. By virtue of this conical surface 19, the needle 12 is thus pushed toward the position in which it releases the pull tab 10 (the position of the needle 12 illustrated in FIG. 7) by compressing the second spring 13.

The position illustrated in FIG. 7 is an unlocking position occurring when the button 3 has been pushed as far as possible into the body 1. The stop finger 24 of the needle 12 has been extracted from the slot 17 and comes to be positioned against the outer surface of the pull tab 10 (see enlarged circle of FIG. 7).

During the movement in which the pull tab 10 is pressed into the sheath 14, two operations are performed sequentially:

- the needle 12 first of all reaches its release position (the stop finger 24 having reached the top of the conical surface 19); then
- the ejection leg 27 of the spring 11 comes into abutment against the lateral blocking surface 29 of the slide 9 and the continuation of the movement causes the slide 9 to be translated in the same direction of translation as the pull tab 10.

This final translational movement of the slide 9 leads the blocking rim 33 of the slide 9 to come to be positioned under the stop shoulder 26 of the needle 12 (this interaction is visible in the enlarged circle of FIG. 7).

In other words, when the user pushes the button 3 to its position of FIG. 7, the pull tab 10 lifts the needle 12 to its release position and the slide 9 is then translated to its immobilization position, in which the slide 9 immobilizes the needle 12 in the release position of the needle.

In the unlocking position of FIG. 7, the pull tab 10 is pressed as far as possible into the body 1, the pressure end 22 forcing the ejection leg 27 against the lateral blocking surface 29 of the slide 9.

Figure 8:
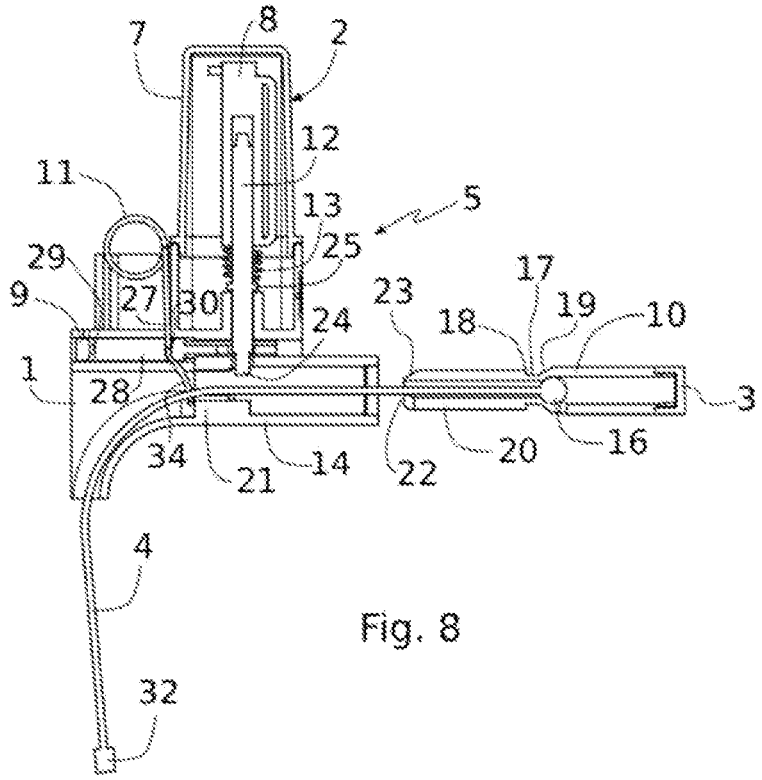
FIG. 8 illustrates the device of FIG. 1 in a second position during mechanical ejection.

From the unlocking position of FIG. 7, when the user releases the pressure on the button 3, the pull tab 10 is then ejected by the ejection leg 27 by virtue of the fact that the stop finger 24 can no longer interfere with the pull tab 10 (see FIG. 8).

At the end of the ejection movement, that is to say at the end of the travel of the ejection leg 27, which pushes the pull tab 10 out of the body 11, the ejection leg 27 moreover comes into abutment against the lateral release surface 30 of the slide 9 and then causes the slide 9 to be translated back toward the position in which it releases the needle 12. The needle 12 is then forced toward its end-of-travel position under the influence of the second spring 13, thus resulting in the position of FIG. 8. In this end-of-travel position, the flange 25 comes to bear against the body 1.

From the position of FIG. 8, the pull tab 10 in the deployed position tilts to the horizontal position in the same way as in FIG. 6. The emergency access device 5 is thus ready for the user to pull on the pull tab 10 and open the door of the vehicle.

In the position of FIG. 8, the device 5 is in a locking position in which the pull tab 10 is in its deployed position, the ejection leg 27 being forced against the lateral release surface 30 of the slide 9 and the slide 9 being in the position in which it releases the needle 12. This locking position of the device 5 corresponds to a position in which the device is ready to receive and lock the pull tab 10 once again in the body 1.

The ejection leg 27 comprises a curved portion 34 designed to come into abutment against the body 1 when the device 5 is in the position of FIG. 8.

Following the emergency access device being triggered by virtue of the electric ejector or by virtue of the mechanical ejector, the pull tab 10 can be put back in place in the body 1 by reintroducing this pull tab 10 into the sheath 14 and translating it into the body 1 so that the longitudinal groove 20 comes to interact with the tongue 21. The bevel 23 of the pressure end 22 forms an oblique path which then pushes the stop finger 24 of the needle 12 upward. After this lifting movement, the stop finger 24 then slides over the outer surface of the pull tab 10 until it comes to be inserted into the slot 17 under the influence of the second spring 13. The device 5 is then in its rest position of FIG. 3.

The spring 11 and its ejection leg 27 thus perform four functions:

- in the rest position of the device 5, the ejection leg 27 forces the stop surface 18 of the pull tab 10 against the stop finger 24 of the needle 12. The rest position of FIG. 3 is thus a stable position. This position is occupied by the device 5 throughout normal operation of the vehicle, that is to say apart from when the emergency device 5 is triggered;
- the ejection leg 27 makes it possible to transmit the movement in which the button 3 is pressed (see FIG. 7) to the slide 9. The translation of the pull tab 10 is transformed into translation of the slide 9 so as to make the slide move into its immobilization position (see FIG. 7);
- the ejection leg 27 ejects the pull tab 10 out of the body 1 as soon as the needle 12 is in its release position and does not retain the pull tab 10 in its withdrawn position; and
- the ejection leg 27 moves the slide 9 translationally back to its release position, when the ejection leg 27 reaches the end of its ejection travel (see FIG. 8).

Figure 9:
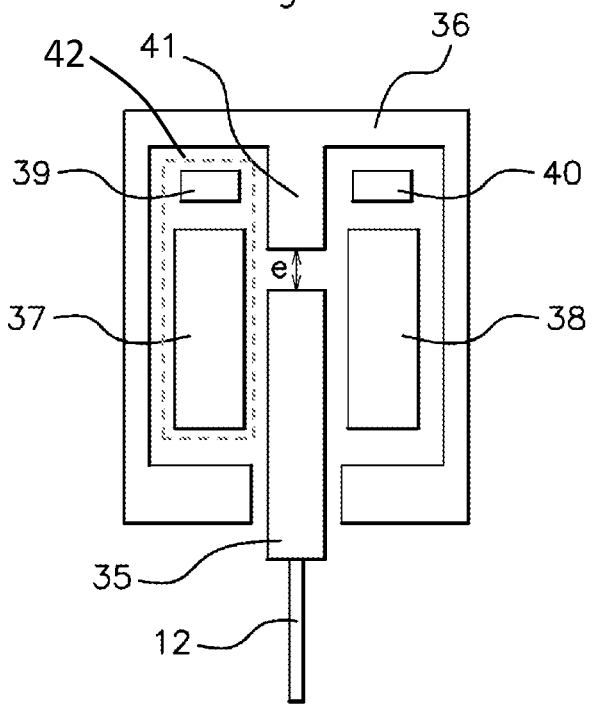
FIG. 9 schematically shows the electric ejector of the device of FIG. 1, in a first position.
Figure 10:
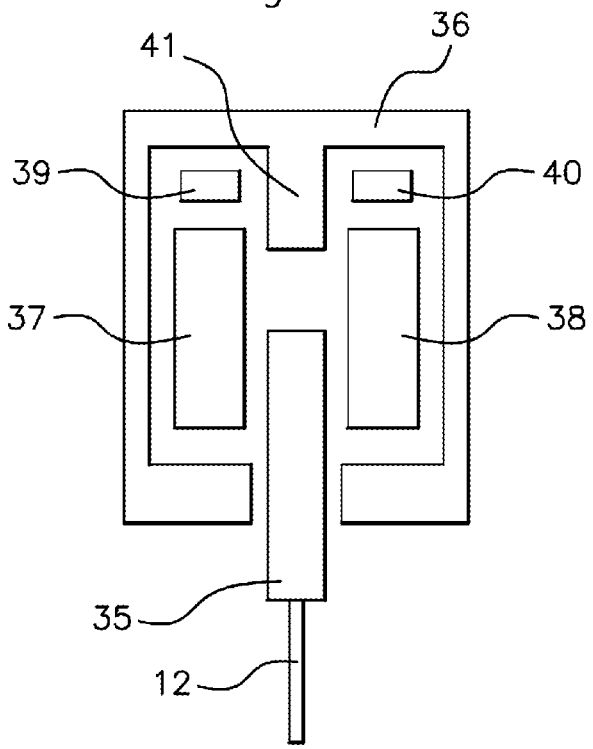
FIG. 10 schematically shows the electric ejector of the device of FIG. 1, in a second position.

FIGS. 9 and 10 are schematic views illustrating the composition of the electric ejector 2, seen in section, in more detail. FIG. 9 illustrates the ejector with the retention needle 12 in its blocking position (corresponding, for example, to FIGS. 3 and 4) and FIG. 10 shows the needle 12 in its end-of-travel position (corresponding, for example, to FIGS. 5, 6 and 8).

The needle 12 comprises a ferromagnetic core 35 which makes it possible to control its movement by means of the electromagnet 8. The electromagnet 8 comprises:

- a magnetic circuit 36 conventionally made of ferromagnetic material, for example from laminated metal sheets;
- an activation coil 37 connected to an electric magnetization circuit 38; and
- a detection coil 39 which is connected to a detection circuit 40 designed to measure the inductance of this detection coil 39.

The magnetic circuit 36 comprises an actuation finger 41 arranged opposite the ferromagnetic core 35 and designed to magnetically attract the core 35 when the activation coil 37 is magnetized. When the needle 12 is in its blocking position of FIG. 9, the actuation finger 41 and the ferromagnetic core 35 have an airgap e.

The activation coil 37 is sized depending on the force required to make the needle 12 move from the blocking position (FIG. 9) to the release position (the core 35 coming into contact with the finger 41) by attracting the ferromagnetic core 35 despite the forces which are applied to the needle 12. The magnetization circuit 38 can be produced by any DC or AC electrical circuit which is designed for this electromagnet function.

The detection coil 39 here has the function of probing the magnetic circuit 36 so as to detect the position of the ferromagnetic core 35 and therefore of the needle 12. The inductance of the magnetic circuit 36, specifically, varies significantly depending on the airgap between the finger 41 and the core 35 (the inductance is inversely proportional to the airgap present between the activation finger 41 and the ferromagnetic core 35). The inductance in the position of FIG. 9 is therefore very different from the inductance in the position of FIG. 10. Since the detection coil 39 is associated with the magnetic circuit 36, the measurement of the inductance of this coil 39 is representative of the position of the needle 12.

The detection coil 39 thus does not participate in any mechanical movement and, as such, requires only very little energy. The detection circuit 40 is therefore intended to supply electric power to this detection coil 39 by delivering a voltage and a very low current to it. The detection coil 39 is preferably supplied with power at high frequency (for example around ten kilohertz), which produces a magnetic skin effect in the magnetic circuit and which makes it possible to overcome the quality of the magnetic material used in the magnetic circuit 36 and its history, that is to say its hysteresis.

The detection circuit 40 further comprises means for measuring the inductance of the detection coil 39. The detection circuit 40 is thus designed to deliver a measurement of the inductance of the detection coil 39 at any time. For example, each time the vehicle is started, the detection circuit 40 can supply power to the detection coil 39 and measure its inductance. The detection circuit 40 preferably in memory comprises thresholds which make it possible to differentiate between measured inductances which correspond to the blocking position of the needle 12 (FIG. 9) and to the end-of-travel position of the needle 12 (FIG. 10). Optionally, the detection circuit 40 also has in memory measured inductance threshold values which also make it possible to detect when the needle 12 is in the release position.

Preferably, the airgap e between the ferromagnetic core 35 and the finger 41 when the needle 12 is in its blocking position is at least equal to the movement distance which it is desired to detect for the needle 12. In other words, in the example of FIGS. 9 and 10, the airgap e is at least equal to the distance separating the needle 12 in its position of FIG. 9 from the needle 12 in its position of FIG. 10.

Thus, each time the vehicle is started, the reading of the inductance of the detection coil 39 by the detection circuit 40 indicates the position of the needle 12. If, during this check when the vehicle is started, the detection circuit 40 determines that the needle 12 is in its end-of-travel position of FIG. 10 (or in its release position), this means that the needle 12 is outside its normal position, in which it blocks the pull tab 10 in the retracted position. These abnormal positions can correspond, for example, for the release position, to the needle 12 being mechanically blocked against the finger 41 and, for the end-of-travel position, to the pull tab 10 being released by virtue of the mechanical ejector. In all these cases, the detection circuit 40 comprises an indicator for indicating the position of the needle 12 and comprises a warning means designed to transmit a warning to the system of the vehicle and which results in a message being displayed for the attention of the driver in the vehicle or by other remote communication means.

Variant embodiments of the emergency access device can be implemented without departing from the scope of the invention. In particular, the detection coil 39 and activation coil 37 can be grouped together in the form of one and the same solenoid 42, which is then supplied with power by the magnetization circuit 38 when it must act as an electromagnet and by the detection circuit 40 when it must act, in proportion to its impedance, so as to detect the position of the needle 12. Optionally, the solenoid 42 can be supplied with power simultaneously or alternately depending on the performance of the magnetization circuit 38 and the detection circuit 40.

Furthermore, FIGS. 9 and 10 relate to a schematic example of the architecture of the magnetic circuit. The magnetic circuit can, for example, alternatively comprise an actuation finger 41 located below the magnetic core, and not above it (with reference to FIGS. 9 and 10).

The invention claimed is:

1. An emergency access device for an opening element of a vehicle, comprising:

a body;

a grippable pull tab which is connected to a lock actuator and can move between: a retracted position in which the pull tab is withdrawn in the body; and a deployed position in which the pull tab protrudes out of the body;

a retention needle which can move transversely to the pull tab and is designed to occupy: a blocking position in which it is arranged against the pull tab, keeping the pull tab in its retracted position; and a position in which the pull tab is released, the retention needle comprising a ferromagnetic core;

a mechanical ejector designed to release the pull tab from its retracted position; and an electric ejector designed to release the pull tab from its retracted position, the electric ejector comprising an electromagnet designed to move the retention needle from its blocking position to its release position, this electromagnet comprising:

a magnetic circuit surrounding the ferromagnetic core of the retention needle;

an activation coil connected to an electric magnetization circuit, the activation coil being designed to magnetize at least a portion of the magnetic circuit and attract the ferromagnetic core of the retention needle; and a detection coil for detecting the position of the retention needle, the detection coil being connected to a detection circuit designed to supply power to the detection coil and measure an inductance of the detection coil.

2. The device as claimed in claim 1, wherein the detection circuit comprises an indicator for indicating the position of the retention needle depending on the measurement of the inductance of the detection coil.

3. The device as claimed in claim 2, wherein the detection circuit comprises a warning device for warning if the indicator indicates a position of the retention needle outside its blocking position.

4. The device as claimed in claim 1, wherein the retention needle is mounted so as to be able to slide in the body and comprises an end-of-travel stop for ending sliding relative to the body, and the retention needle is designed to occupy, in addition to the blocking position, an end-of-travel position in which the end-of-travel stop is against the body.

5. The device as claimed in claim 1, wherein the magnetic circuit comprises an actuation finger arranged opposite the ferromagnetic core of the retention needle and configured to magnetically attract the ferromagnetic core when the activation coil is magnetized.

6. The device as claimed in claim 4, wherein an airgap between the ferromagnetic core and the actuation finger, when the retention needle is in its blocking position, is at least equal to a distance separating the blocking position of the retention needle from at least one of the end-of-travel position or the release position.

7. The device as claimed in claim 1, wherein the activation coil and the detection coil are produced by one and the same solenoid arranged in the magnetic circuit, the solenoid being alternately connected to the electric magnetization circuit and to the detection circuit.

8. The device as claimed in claim 1, wherein the activation coil and the detection coil are produced by one and the same solenoid arranged in the magnetic circuit, the solenoid being simultaneously connected to the electric magnetization circuit and to the detection circuit.

9. The device as claimed in claim 1, wherein the detection coil is supplied with power by the detection circuit at a frequency close to 10 KHz.

10. A vehicle comprising:

an opening element provided with a lock; and an emergency access device as claimed in claim 1, the lock actuator of which is connected to said lock.

11. A method for controlling an emergency access device for an opening element of a vehicle as claimed in claim 3, the method comprising:

supplying, by the detection circuit, electric power to the detection coil;

measuring, by the detection circuit, the inductance of the detection coil; and activating a warning device if the measured inductance relates to a position of the retention needle which is outside its blocking position.

12. An emergency access device for an opening element of a vehicle, comprising:

a body;

a grippable pull tab which is connected to a lock actuator and can move between: a retracted position in which the pull tab is withdrawn in the body; and a deployed position in which the pull tab protrudes out of the body;

a retention needle which can move transversely to the pull tab and is designed to occupy: a blocking position in which it is arranged against the pull tab, keeping the pull tab in its retracted position; and a position in which the pull tab is released, the retention needle comprising a ferromagnetic core;

a mechanical ejector designed to release the pull tab from its retracted position; and an electric ejector designed to release the pull tab from its retracted position, the electric ejector comprising an electromagnet designed to move the retention needle from its blocking position to its release position, this electromagnet comprising:

a magnetic circuit surrounding the ferromagnetic core of the retention needle;

an activation coil connected to an electric magnetization circuit, the activation coil being designed to magnetize at least a portion of the magnetic circuit and attract the ferromagnetic core of the retention needle; and a detection coil for detecting the position of the retention needle, the detection coil being connected to a detection circuit designed to supply power to the detection coil and measure an inductance of the detection coil, wherein the activation coil and the detection coil are produced by one and the same solenoid arranged in the magnetic circuit.

* * * * *